US009994366B2

(12) United States Patent
Ehmer et al.

(10) Patent No.: US 9,994,366 B2
(45) Date of Patent: Jun. 12, 2018

(54) CLOSURE FOR DRINK CONTAINERS

(75) Inventors: Wilfried Ehmer, Dortmund (DE); Alois Monzel, Morstadt (DE)

(73) Assignee: KHS GmbH, Dortmund (DE)

( * ) Notice: Subject to any disclaimer, the term of this patent is extended or adjusted under 35 U.S.C. 154(b) by 1004 days.

(21) Appl. No.: 12/921,491

(22) PCT Filed: Mar. 6, 2009

(86) PCT No.: PCT/EP2009/001594

§ 371 (c)(1),
(2), (4) Date: Sep. 8, 2010

(87) PCT Pub. No.: WO2009/118090

PCT Pub. Date: Oct. 1, 2009

(65) Prior Publication Data

US 2011/0000926 A1 Jan. 6, 2011

(30) Foreign Application Priority Data

Mar. 28, 2008 (DE) ..... 10 2008 016 320

(51) Int. Cl.

| | |
|---|---|
| ***B65D 53/00*** | (2006.01) |
| ***B65D 39/00*** | (2006.01) |
| ***B65D 41/16*** | (2006.01) |
| ***B65D 41/18*** | (2006.01) |

(52) U.S. Cl.
CPC ..... *B65D 39/0041* (2013.01); *B65D 39/0023* (2013.01)

(58) Field of Classification Search
CPC ..... B65D 43/021; B65D 2543/00537; B65D 41/0435; B65D 39/00
USPC ..... 220/789, 792, 795; 215/341, 355
See application file for complete search history.

(56) References Cited

U.S. PATENT DOCUMENTS

| | | | | |
|---|---|---|---|---|
| 296,876 | A | 4/1884 | Rosenzi | |
| 4,497,758 | A | 2/1985 | Clark | |
| 4,572,399 | A | 2/1986 | Bock | |
| 5,031,785 | A * | 7/1991 | Lemme | 215/228 |
| 5,535,900 | A * | 7/1996 | Huang | 215/228 |
| 5,680,954 | A * | 10/1997 | Arnold et al. | 220/300 |
| 5,988,423 | A * | 11/1999 | Auzureau | 220/233 |

(Continued)

FOREIGN PATENT DOCUMENTS

| | | |
|---|---|---|
| CN | 2542594 | 4/2003 |
| DE | 36 08 300 A1 | 3/1986 |
| DE | 9306792 | 9/1994 |

(Continued)

OTHER PUBLICATIONS

International Preliminary Report on Patentability received in International Application No. PCT/EP2009/001594 dated Nov. 18, 2010.

*Primary Examiner* — Andrew T Kirsch
(74) *Attorney, Agent, or Firm* — Occhiuti & Rohlicek LLP

(57) ABSTRACT

A closure for beverage containers that have a substantially cylindrical neck with an end opening and a closure cap includes a neck with an inside circumferential detent collar and a closure cap having an insertion shaft. A circumferential detent groove is provided on an outer circumference of the shaft. The detent groove corresponds to the detent collar, is profiled in a direction of insertion, and engages over the detent collar on a ring surface thereof that lies in the direction of insertion.

17 Claims, 3 Drawing Sheets

(56) References Cited

U.S. PATENT DOCUMENTS

| | | | | |
|---|---|---|---|---|
| 6,834,770 | B2 * | 12/2004 | Lo | 220/212.5 |
| 2004/0045965 | A1 | 3/2004 | Dwinell | |

FOREIGN PATENT DOCUMENTS

| | | | |
|---|---|---|---|
| DE | 101 38 365 | A1 | 2/2003 |
| EP | 0 915 283 | A2 | 5/1999 |
| GB | 671899 | | 5/1952 |
| WO | 94/25360 | | 11/1994 |
| WO | 2007/064277 | | 6/2007 |

* cited by examiner

CLOSURE FOR DRINK CONTAINERS

CROSS-REFERENCE TO RELATED APPLICATIONS

This application is the National Stage of International Application No. PCT/EP2009/001594, filed on Mar. 6, 2009, which claims the benefit of German Application Serial No. 10 2008 016 320.1, filed on Mar. 28, 2008, the contents of both of the foregoing applications are hereby incorporated by reference in their entirety.

FIELD OF DISCLOSURE

The invention relates to a closure for beverage containers having a substantially cylindrical neck with an end opening and a closure cap.

BACKGROUND

Various kinds of beverage containers with generic closures are known. These are widely used as keg vessels. In the majority of cases, keg vessels are made from metal and, where applicable, have rubber casings. At the top end, the keg vessels have a substantially cylindrical neck with an end opening. This opening is closed with a closure cap. The cap conventionally has a valve and a connection for a coupling element to a tap. The valve is connected to a tube that is located inside the vessel and that extends to the bottom region of the vessel. Overpressure in the keg vessel's interior presses the contents of the keg vessel up to the valve via this tube.

A number of different systems are known for connecting the closure cap to the neck. WO 2007/064277 A1, for example, shows an arrangement where the closure cap engages over the neck on the outside. A positive locking arrangement between circumferential grooves and corresponding collars locks the closure cap to the vessel's neck. In addition, a circumferential ring on the neck underneath the closure cap is necessary for the stabilization and handling of the vessel.

Additional vessel closures are made known, for example, in DE 101 38 365 A1, EP 0 915 283 B1, and DE 36 08 300 A1.

The prior art container closures are complex, costly, and difficult to clean. Additionally, to achieve stability, they require strengthening in the neck region. This strengthening enables them to absorb the sometimes high-pressure loads in the interior of the vessel.

SUMMARY

The invention provides a simple, reliable closure that yields a neck arrangement having the same or even greater stability than those in the prior art.

In the closure cap described herein, an inside detent collar interacts with a detent groove that is located on an outside circumference of a substantially ring-shaped insertion shaft in such a manner that, after the closure cap has been inserted, the detent groove, which has a tapering profile, can be displaced over the detent collar. After it has been pushed in, it engages over the detent collar on the underside so that the detent groove is locked in a circumferential manner to the ring surface of the detent collar that lies in the direction of insertion. This ensures reliable holding of the closure cap. A tapered profile of the detent groove in the direction of insertion makes simple insertion of the cap possible. The dimensions of the effective depths of the detent collar and corresponding detent groove are selected to ensure a secure hold on the closure cap.

As a result, surface features necessary for holding the cap are in the interior of the neck. This leaves the outside neck region free for development features while preserving or enhancing the stability of the overall arrangement.

The container development according to the invention offers a number of advantages compared to the known container developments.

One advantage is that the outside of the container neck can take on multifarious developments depending on the desired application. For example, the outside of the neck can be totally smooth, or it can have a circumferential ring for compatibility with existing systems. It can even have a circumferential groove, the result of which is a particularly compact and nevertheless reliably graspable container.

Another advantage is that the inside locking of the container to the closure cap results in a reliable connection between the two elements. This reliably protects the contents of the container against environmental influences and provides a high degree of pressure resistance.

In some embodiments, the closure cap has a circumferential support and/or guiding ring that engages over the neck on the outside.

The ring is developed such that it engages over the neck opening on the outside. This enables precise guiding of the cap when it is being fitted. It also makes possible a transfer of force from the inside insertion shaft via the topside of the closure cap to the outside of the neck. This improves the stability and the holding characteristics of the cap arrangement.

In some embodiments, a seal is provided on the ring surface of the detent collar on the opening side.

An upper circumferential sealing ring yields the advantageous possibility of sealing the beverage container from the environment. This is because the closure cap, once fitted, is pressed against the seal and locks on the lower ring surface of the detent collar so that a reliable and strong pressing force acts on the seal. As a result, the seal becomes quite reliable.

In some embodiments, a seal is provided on the outer surface of the insertion shaft.

By dimensioning the individual parts in a corresponding manner, in particular, by dimensioning the sealing ring, a good sealing effect can also be achieved between the inside surface of the detent collar and the outside surface of the insertion shaft by placing a seal between the two.

In one embodiment, the neck has a circumferential support ring on the outside.

Such support rings, also called neck rings, are known for certain versions of keg vessels. However, in the prior art, support rings are used for stabilizing the overall arrangement. This is precisely what is not necessary in the case of the neck development according to the invention. Nevertheless, a corresponding ring can be provided on the outside. The ring, in this case, is used substantially to retain compatibility with existing filling or tap systems. However, as a result of the inventive features on the neck, the support ring is no longer necessary for the actual stability and functioning of the container closure.

Consequently, since no neck ring is needed, it can be omitted. As a result, some embodiments include a neck that has a circumferential holding and/or guiding groove on the outside.

Such a groove can also be provided to facilitate automatic beverage container handling. Containers can be reliably grasped at such a groove and conveyed through the systems necessary for filling and the like. Since, as mentioned, the neck development according to the invention no longer requires structural measures disposed outside the neck for increasing stability, container handling can rely on the groove instead of the now unnecessary support ring that had hitherto provided this function.

In some embodiments, the neck has a circumferential support ring on the inside. Having a support ring on the inside can stabilize the overall arrangement even further.

In particular, such a support ring supports mechanical loads from outside and loads resulting from overpressure in the interior.

In this case, it can be advantageous for the circumferential support ring on the inside to be developed in such a manner that when the closure cap is deformed, the detent groove jams with the support ring.

In such an embodiment, the support ring sits underneath the circumferential detent collar at a spacing that is required for allowing reliable entering and locking of the detent groove to the lower ring surface of the detent collar. In addition, the spacing is selected such that when the closure cap is deformed, the corresponding bending-up transferred by the insertion shaft acts in such a manner on the detent groove that the detent groove contacts the support ring below. This generates a jamming effect that further increases stability.

BRIEF DESCRIPTION OF THE DRAWINGS

Additional advantages and features of the invention are produced from the drawings, in which.

DETAILED DESCRIPTION

Figure 1:
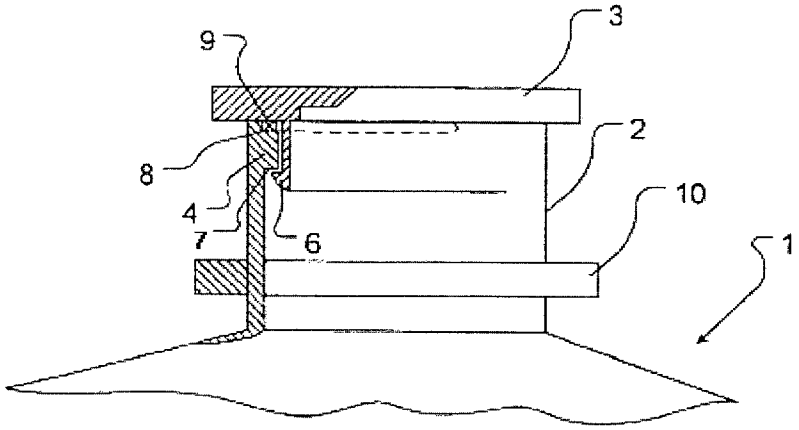
FIG. 1 shows a partially sectional side view of a first embodiment of a closure according to the invention.

A beverage container 1, as shown in FIG. 1, has a substantially cylindrical neck 2. A closure cap 3 is located at the upper opening of the neck 2. An opening for an extraction valve is situated in the closure cap 3.

The neck 2 has an interior circumferential detent collar 4 that extends radially inward. The circumferential detent collar 4 has a first ring surface 7 and a second ring surface 8. These surfaces are called "ring surfaces" because they look like rings. The first ring surface 7 faces the direction of insertion. The second ring surface 8 faces away from the direction of insertion.

The closure cap 3 has an insertion shaft 5 that extends downward from the cap 3. A circumferential detent groove 6 is located at the end of the insertion shaft 5 remote from the cap 3. The detent groove 6 is profiled to be beveled in the direction of insertion. This makes it easier to insert the closure cap 3 into the neck 2.

Upon insertion of the cap 3, the detent groove 6 engages over the first ring surface 7. A first ring seal 9 is located on the second ring surface 8 of the detent collar 4. In addition, a circumferential support ring 10 extends radially outward to enable the beverage container 1 to be reliably grasped using known systems.

Figure 2:
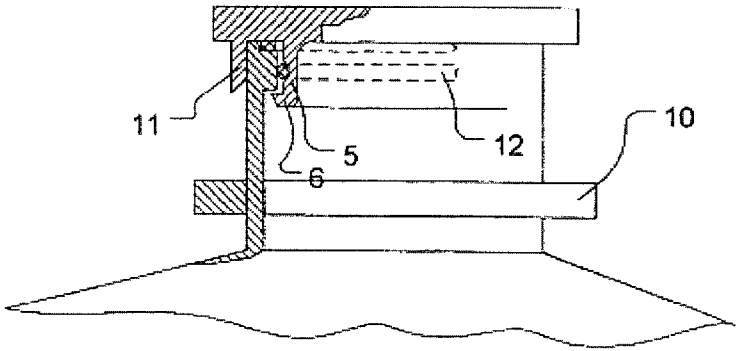
FIG. 2 shows a partially sectional side view of a second embodiment of a closure according to the invention.

An alternative embodiment, shown in FIG. 2, is similar to the embodiment represented in FIG. 1. However, in addition to the features shown in FIG. 1, the closure cap 3 shown in FIG. 2 also has a support and/or guiding ring 11 that extends downward along a first surface of the neck opening. The ring 11 and the detent groove 6 cooperate to generate a counter force against the insertion shaft 5, which extends downward into the interior along a second surface of the neck opening. The ring 11, in addition, further simplifies the fitting process by having a lower end that is inclined in the direction of insertion.

A circumferential second ring seal 12 between the surface of the insertion shaft 5 and the container neck cooperates with the first ring seal 9 lying on the detent collar 4 to further improve sealing.

Figure 3:
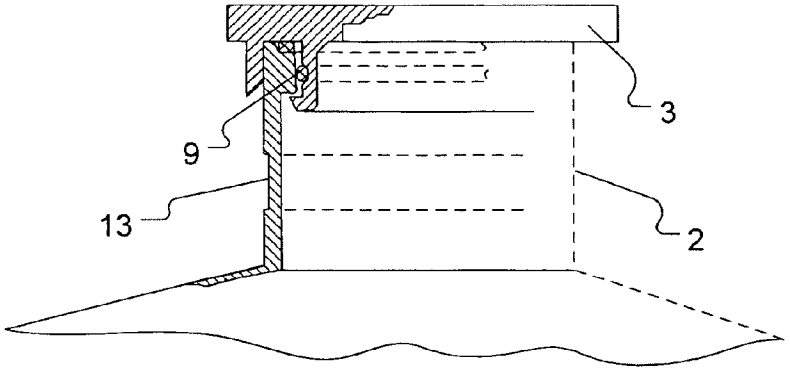
FIG. 3 shows a partially sectional side view of a third embodiment of a closure according to the invention.

The embodiment shown in FIG. 3 is similar to that shown in FIG. 2, but with the neck 2 of the beverage container 1 having a circumferential holding and/or guiding groove 13. The groove 13 provides an alternative way to grasp the container 1 at its neck 2 and to mechanically move the container 1.

Figure 4:
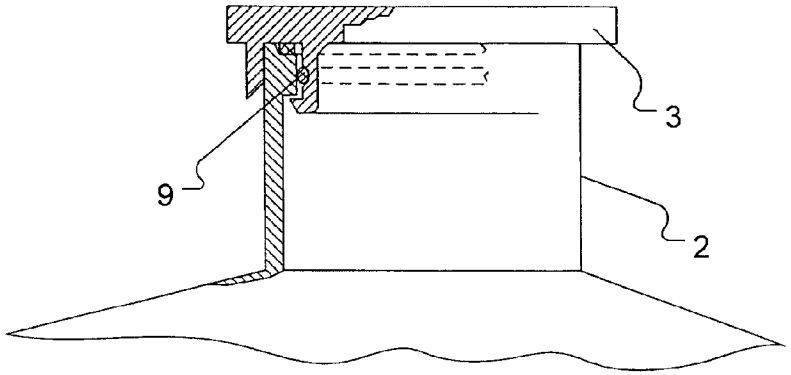
FIG. 4 shows a partially sectional side view of a fourth embodiment of a closure according to the invention and FIG. 5 shows a partially sectional side view of a fifth embodiment of a closure according to the invention.

In another embodiment, shown in FIG. 4, the outside of the neck 2 is completely flat and thus has neither a support ring 10 nor a holding and/or guiding groove 13. The embodiment shown in FIG. 4 is otherwise analogous to the previously described embodiments. In particular, the embodiment shown in FIG. 4 has a similar closure cap 3 and opening region of the beverage container neck 2.

Figure 5:
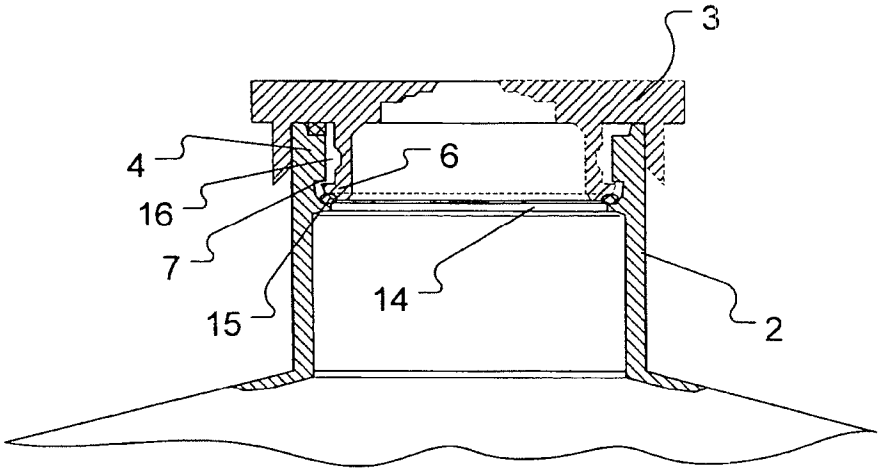

An embodiment shown in FIG. 5 includes an inside circumferential support ring 14. The support ring 14 mechanically stabilizes the neck opening. In addition, there is a space between support ring 14 and the ring surface of the detent collar 4 that is situated opposite in the direction of the opening. This space is selected in such a manner that the detent groove 6 engages in the groove formed between the support ring 14 and the ring surface 7. The spacing is additionally selected such that deformation of the closure cap 3 results in a jamming between the groove 6 and the support ring 14 in connection with the ring surface 7. This can considerably increase the stability of the overall arrangement.

The embodiment shown in FIG. 5 is further improved by a third ring seal 15 that is located between the lower end of the detent groove 6 and the support ring 14. The third ring seal 15 is located so that a ring space 16 that is formed between neck 2 and the detent groove 6 is completely hermetically sealed. The bridging of the spacing between detent groove 6 and support ring 14 by the third ring seal 15 results in further mechanical support of the closure cap 3. As a result, the closure cap 3 can be even flatter and can have more delicate features.

Naturally, the invention is not limited to the present exemplary embodiments, but can be converted in a wide respect without departing from the inventive concept.

Thus, for example, the developments of the neck just as the dimensioning of the individual components are dependent on the application and are variable.

Having described the invention, and a preferred embodiment thereof, what is claimed as new, and secured by Letters Patent is:

1. A closure for kegs having a substantially cylindrical neck with an end opening and a closure cap, wherein the neck has an inside circumferential detent collar and wherein the closure cap has an insertion shaft, an opening for receiving an extraction valve, and a circumferential detent groove provided on an outer circumference thereof, the detent groove corresponding to the detent collar and being profiled in a direction of insertion, wherein the detent groove engages over the detent collar on a ring surface thereof that lies in the direction of insertion, wherein the closure cap has a circumferential support and/or guide ring that engages over an outside of the neck, wherein the closure further comprising a structure selected from the group consisting of a seal, a circumferential retaining and/or guiding groove, and a circumferential support ring, wherein the seal is on a ring surface of the detent collar on an opening side thereof, wherein the circumferential retaining and/or guiding groove is on an outside of the neck, and wherein the circumferential support ring is on an inside of the neck.

2. The closure according to claim 1, wherein the selected structure is the seal.

3. The closure according to claim 1, further comprising a seal on the outer surface of the insertion shaft.

4. The closure according to claim 1, wherein the selected structure is the circumferential retaining and/or guiding groove.

5. The closure according to claim 1, wherein the selected structure is the circumferential support ring.

6. A closure for kegs having a substantially cylindrical neck with an end opening and a closure cap, wherein the neck has an inside circumferential detent collar and wherein the closure cap has an insertion shaft, an opening for receiving an extraction valve, and a circumferential detent groove provided on an outer circumference thereof, the detent groove corresponding to the detent collar and being profiled in a direction of insertion, wherein the detent groove engages over the detent collar on a ring surface thereof that lies in the direction of insertion, said closure further comprising a seal on a ring surface of the detent collar on an opening side thereof.

7. The closure according to claim 6, further comprising a seal on the outer surface of the insertion shaft.

8. The closure according to claim 6, further comprising a circumferential support ring on an outside of the neck.

9. The closure according to claim 6, further comprising a circumferential retaining and/or guiding groove on an outside of the neck.

10. The closure according to claim 6, further comprising a circumferential support ring on an inside of the neck.

11. A closure for kegs having a substantially cylindrical neck with an end opening and a closure cap, wherein the neck has an inside circumferential detent collar and wherein the closure cap has an insertion shaft, an opening for receiving an extraction valve, and a circumferential detent groove provided on an outer circumference thereof, the detent groove corresponding to the detent collar and being profiled in a direction of insertion, wherein the detent groove engages over the detent collar on a ring surface thereof that lies in the direction of insertion, said closure further comprising a circumferential retaining and/or guiding groove on an outside of the neck.

12. The closure according to claim 11, further comprising a circumferential support ring on an inside of the neck.

13. The closure according to claim 12, wherein the circumferential support ring is configured such that deformation of the closure cap jams the detent groove with the support ring.

14. The closure according to claim 11, further comprising a circumferential support ring on an outside of the neck.

15. A closure for kegs having a substantially cylindrical neck with an end opening and a closure cap, wherein the neck has an inside circumferential detent collar and wherein the closure cap has an insertion shaft, an opening for receiving an extraction valve, and a circumferential detent groove provided on an outer circumference thereof, the detent groove corresponding to the detent collar and being profiled in a direction of insertion, wherein the detent groove engages over the detent collar on a ring surface thereof that lies in the direction of insertion, wherein said closure further comprises a seal on the outer surface of the insertion shaft and a circumferential retaining and/or guiding groove on an outside of the neck.

16. The closure according to claim 15, further comprising a circumferential support ring on an outside of the neck.

17. A closure for kegs having a substantially cylindrical neck with an end opening and a closure cap, wherein the neck has an inside circumferential detent collar and wherein the closure cap has an insertion shaft, an opening for receiving an extraction valve, and a circumferential detent groove provided on an outer circumference thereof, the detent groove corresponding to the detent collar and being profiled in a direction of insertion, wherein the detent groove engages over the detent collar on a ring surface thereof that lies in the direction of insertion, further comprising a circumferential support ring on an outside of the neck, said closure further comprising a circumferential retaining and/or guiding groove on an outside of the neck.

* * * * *